US008911104B2

(12) United States Patent
Wylie

(10) Patent No.: US 8,911,104 B2
(45) Date of Patent: Dec. 16, 2014

(54) MOUNTING BRACKET AND WIRING SYSTEM FOR LINEAR LED TUBE LIGHTING

(76) Inventor: Scott Brian Wylie, Phoenix, AZ (US)

( * ) Notice: Subject to any disclaimer, the term of this patent is extended or adjusted under 35 U.S.C. 154(b) by 696 days.

(21) Appl. No.: 13/274,011

(22) Filed: Oct. 14, 2011

(65) Prior Publication Data

US 2013/0094202 A1 Apr. 18, 2013

(51) Int. Cl.

| | |
|---|---|
| ***F21V 21/00*** | (2006.01) |
| ***F21V 21/005*** | (2006.01) |
| ***F21V 21/08*** | (2006.01) |
| *F21V 33/00* | (2006.01) |

(52) U.S. Cl.

CPC ..... *F21V 21/005* (2013.01); *F21V 33/0012* (2013.01); *F21V 21/0808* (2013.01)

USPC ..... 362/217.16; 362/225; 362/217.12

(58) Field of Classification Search

USPC ..... 362/217.01, 217.1, 217.14, 362, 365, 362/370

See application file for complete search history.

(56) References Cited

U.S. PATENT DOCUMENTS

| | | | | |
|---|---|---|---|---|
| 6,609,813 | B1 | 8/2003 | Showers | |
| 6,846,094 | B2 | 1/2005 | Luk | |
| 7,296,912 | B2 | 11/2007 | Beauchamp | |
| 7,478,936 | B2 | 1/2009 | Chen | |
| 7,857,473 | B2 | 12/2010 | Shibusawa | |
| 7,926,977 | B2 * | 4/2011 | Nall et al. | 362/249.02 |
| 7,954,979 | B2 | 6/2011 | Sommers | |
| 7,959,334 | B2 * | 6/2011 | Tsai et al. | 362/396 |
| 7,963,661 | B2 | 6/2011 | Meeks | |
| 7,976,181 | B2 | 7/2011 | Kelly | |
| 8,002,434 | B2 | 8/2011 | Sommers | |
| 8,398,275 | B2 * | 3/2013 | Wang et al. | 362/372 |
| 2004/0105261 | A1 * | 6/2004 | Ducharme et al. | 362/231 |
| 2004/0257802 | A1 * | 12/2004 | Helenowski | 362/217 |
| 2005/0265019 | A1 * | 12/2005 | Sommers et al. | 362/217 |
| 2005/0270774 | A1 | 12/2005 | Pan | |
| 2007/0165398 | A1 * | 7/2007 | Kurtz et al. | 362/217 |
| 2009/0219720 | A1 * | 9/2009 | Reed | 362/308 |
| 2009/0316385 | A1 | 12/2009 | Weber | |
| 2011/0128740 | A1 * | 6/2011 | Hartmann et al. | 362/287 |
| 2011/0310604 | A1 * | 12/2011 | Shimizu et al. | 362/235 |
| 2011/0317435 | A1 * | 12/2011 | Wang | 362/370 |
| 2012/0002418 | A1 | 1/2012 | Wang | |

* cited by examiner

*Primary Examiner* — Donald Raleigh

(57) ABSTRACT

A mounting bracket for a linear LED tube-type light to be installed principally inside of display cases, shelves and soffits. In one embodiment, a cylindrical bracket is mounted to each side of a display case and an LED tube light (a semi-cylinder with mounted LED circuit boards) is inserted into these brackets and secured with a set screw. This bracket/tube system allows for power harness wiring through either side of the case or through a down rod at various positions to the bracket. Additional embodiments allow for mounting said brackets to the underside of the case glass or side walls using adhesive. Further embodiments incorporate this same cylindrical bracket design to mount the LED light tube to the front edge of shelves or on to a flat pedestal for mounting to a variety of flat surfaces such as a wall or ledge. Additional related embodiments are described and shown herein.

13 Claims, 11 Drawing Sheets

MOUNTING BRACKET AND WIRING SYSTEM FOR LINEAR LED TUBE LIGHTING

FIELD OF INVENTION

This invention relates to a system for mounting tubular LED light bars for use in retail display case lighting, under-cabinet lighting and soffit lighting. This invention additionally relates to a method of routing and hiding from view the wire harness leading to the LED light bar.

BACKGROUND

Many display cases currently use halogen or fluorescent tube lighting to provide lighting to the inside of the case. These light bars are generally bulky, generate a substantial amount of heat which can damage the displayed product, and are less efficient than newer LED lighting products. Additionally, halogen and fluorescent bulbs require more frequent bulb changes which increase the cost of maintaining these fixtures over their lifetime. LED lighting can last up to 10 years without replacement depending on the number of hours the lights are on each day.

Halogen lighting is limited to one light temperature of approximately 2700 k. Fluorescent lighting is typically available in a wider range of color temperatures from 2700 k to 6500 k. However, these color temperatures may still not be suitable to the customer's needs or may not be available for purchase in the market since they are a specialty lamp that may not be available at standard lighting retailer suppliers. LED lighting is available in all shades of white as well as combinations of red, green and blue colors.

Additionally, fluorescent tube lighting is limited in its ability to fill the entire length of an area evenly with light since light tubes are only available in certain lengths such as 12", 18", 24" 36" and 48". A 67" display case would need to incorporate a 24" and a 36" tube and its related fixture to light the inside of a case.

Halogen light bulbs must be spaced reasonably apart to allow for heat dissipation which can cause hot spots within the case where the bulbs are positioned.

Relative to LED lighting products, both halogen and fluorescent light bulbs are larger than newer LED products and require larger and stronger light fixtures to house these bulbs.

Generally, store owners complain that halogen lighting is too warm of a shade of white and fluorescent lighting is too flat and does not provide a substantially intense source of light to satisfactorily illuminate their products on display.

LED lighting does not emit UV rays. Both halogen and fluorescent lights emit UV rays which are damaging to many products when exposed for a certain period of time.

LED lighting provides for better illumination of jewelry due to the reflection of the small LED light that is reflected off of each stone and facetted cut of jewelry.

All fluorescent and some halogen lighting is powered by 110v AC power and requires a licensed electrician to install the fixtures to code oftentimes utilizing bulky brackets, heavy gauge wire harnesses and large wire raceways.

Store owners complain that existing halogen and fluorescent lighting fixtures are too bulky blocking the view of products on display on shelves or in display cases. New LED technology has now provided for smaller light tubes as small as ½ inch in diameter, substantially smaller than halogen or fluorescent light fixtures which average two to three inches in diameter. This smaller size permits the fixture to be less obtrusive, lighter and easier to install, allowing for smaller bracketing of the light tube.

LED lights use low voltage power and consume less power than other types of lighting allowing for the use of smaller, less obtrusive wire harnesses and raceways. Additionally, LED lighting does not use a ground wire as halogen and fluorescent use making for an even smaller wire harness.

Some display cases do not have existing lighting and have not been constructed with empty areas where wire harnesses can be routed out of view from the customer. There currently exists the need for new linear display case lighting that is very small in diameter and easy to install, while also providing for the wire harness to be hidden from view when possible.

Currently LED lighting tubes are attached to the inside of cases with a standard "L" type bracket. It is both unsightly and does not allow for the wire harness to be hidden from view. Other types of attachment methods currently being used are hook and loop fasteners to hold the light bar in place which is unsightly and undependable, and post-mounted which obstructs the use of the display case area. Post mounting the light bar also requires substantially more time to install due to having to exactly place the posts inside the case and run wiring inside one of the posts to the light bar.

A more common method of installation is to have the light tube built in to the display case. Additionally, this method does not allow the tube to be adjusted for directing the beam angle of the light. This method does not normally allow for easy removal and replacement of the light if needed. This type of installation may not be possible or practical on existing cases already in place in stores. Removal of the entire display case would be required to retrofit the light tubes into the case using this method.

Because of new LED technology, there also exists the need to place tube lighting under cabinets, on shelves and on soffit walls where the light direction can be adjusted and the wire harnesses obscured from view. LED lighting provides a wide range of color choices and intensities as well as special effects like color mixing, dimming and color fading that is not available using standard halogen or fluorescent lighting.

SUMMARY OF INVENTION

This is a system of mounting an LED light tube to the inside of a product display case, mounted on the sides of the case or on the underside of the top glass. Additionally this design can be used for mounting LED light tubes to any surface to be lit such as glass or wood shelving, the undersides of cabinets or on a soffit wall.

ADVANTAGES

There are several advantages to this invention which are as follows:

1. to provide a simple and easy system to mount and install LED light tubes in multiple applications, principally inside of display cases where access is difficult and installation time is restricted or limited.
2. To provide a bracket or flange that allows the wire harness and connector to be easily inserted into the bracket after it is installed and ready to connect to the corresponding light tube's circuit board. Removal or replacement of the wire harness does not require removal of the brackets.
3. To allow flexibility in how the wire harness is to be threaded through the bracket depending on different designs of cases and differing requirements for connecting to power, such as using a down rod or threading through the side of the case.

4. To allow the power wire harness to feed from either side of the display case and light tube without having to remove and switch the brackets.
5. To provide a bracket that allows the wire harness to feed either through the side of the case or within a down rod to the bottom of the case if there are no alternative means to do so.
6. To provide a bracket design using the same concept that can, instead, be mounted to the underside of the top glass of the display case in the event that it is not feasible or desirable to install the brackets on the side of the case.
7. To provide a bracket that can be adhered to the side of a display case where it is not desirable or practical to drill a small hole and install a small attachment screw to hold the bracket in place, such as in the case of glass or metal sides of the display case.
8. To provide a bracket that can mount to the edge of glass shelves without drilling or gluing the bracket onto the shelf. This method allows for quick removal and reinstallation without altering the glass shelf.
9. To provide a bracket system of this same design that can be mounted to any flat or semi-flat surface where linear LED lighting is desired.
10. To provide a rugged bracket system that can withstand normal usage during store operations that will not easily break free from its attachment, but can be removed with relative ease leaving very little or no traces of being installed.
11. To provide a lighting tube system that can be easily cut to a specified size without exact measurements and fit to the case with or without field modification. A system that allows the light to fit an area approximately ½ inch less or more than the specified area to be fit.
12. To provide a lighting tube and bracket system that can be easily shortened to fit if necessary.
13. To provide a lighting tube and bracket system that allows for a reasonable amount of articulation of the light beam angle within the case or on the displayed object. This adjustment is simple and quick.
14. To provide a lighting tube and bracket system that is simple enough to allow the customer and repair technicians to install and remove the light tube and bracket themselves with minimal or no instruction.

DRAWINGS—FIGURES

In the drawings, closely related figures have the same number but different alphabetic suffixes.

DRAWINGS—REFERENCE NUMERALS

| | |
|---|---|
| 10. | Bracket body |
| 11. | Optional extension to connector pass-through |
| 12. | Bracket base |
| 13. | Optional, additional set screw |
| 14. | Bracket hole for mounting screw |
| 15. | Set screw |
| 16. | Cut-out or pass-through for wire harness |
| 17. | Pilot hole |
| 18. | Space for wire |
| 19. | Wire path |
| 20. | Connector pass-through |
| 21. | Adhesive strip |
| 22. | Left side wire pass-through |
| 23. | Pass-through to side of case |
| 24. | Right side wire pass-through |
| 25 | Long set screw |
| 26. | Set screw |
| 28. | Flange inside |
| 30. | Locking collar |
| 31. | Locking collar pinch points |
| 32. | Light tube housing |
| 34. | LED circuit board |
| 36. | LED |
| 38. | Circuit board connector |
| 40. | Wire harness connector |
| 42. | Wire harness |
| 44. | Wire harness down rod |
| 46. | Display case glass (top) |
| 48. | Display case glass (front) |
| 50. | Display case glass (side) |
| 52. | Display case side |
| 54. | Clear space for wire |
| 56. | Space to adjust beam angle of light |
| 58. | Space to run wire harness under locking collar |

-continued

| | |
|---|---|
| 60. | LED circuit board mounting pedestal |
| 61. | Alternate style of light tube extrusion |
| 62. | Adhesive to connect pedestal to light tube |
| 64. | Polycarbonate flange base |
| 66. | Polycarbonate flange base bevel |
| 68. | UV-cure adhesive |
| 70. | UV lamp |
| 71. | UV light rays |
| 72. | Bracket base lip |
| 74. | Glass-mount bracket |
| 75. | Flat face of bracket |
| 76. | Glass-mount bracket bevel for adhesive |
| 77. | Side-glass-to-top-glass adhesive residue |
| 78. | Glass adhesive |
| 79. | Flat edge of bracket for adhesive |
| 80. | Double-side adhesive tape |
| 82. | Epoxy adhesive |
| 84. | U-channel |
| 86. | Glass shelf |
| 88. | Set screw |
| 90. | Base plate |
| 92. | Wall, floor, shelf or ledge |
| 94. | Mounting screw |

Figure 1:
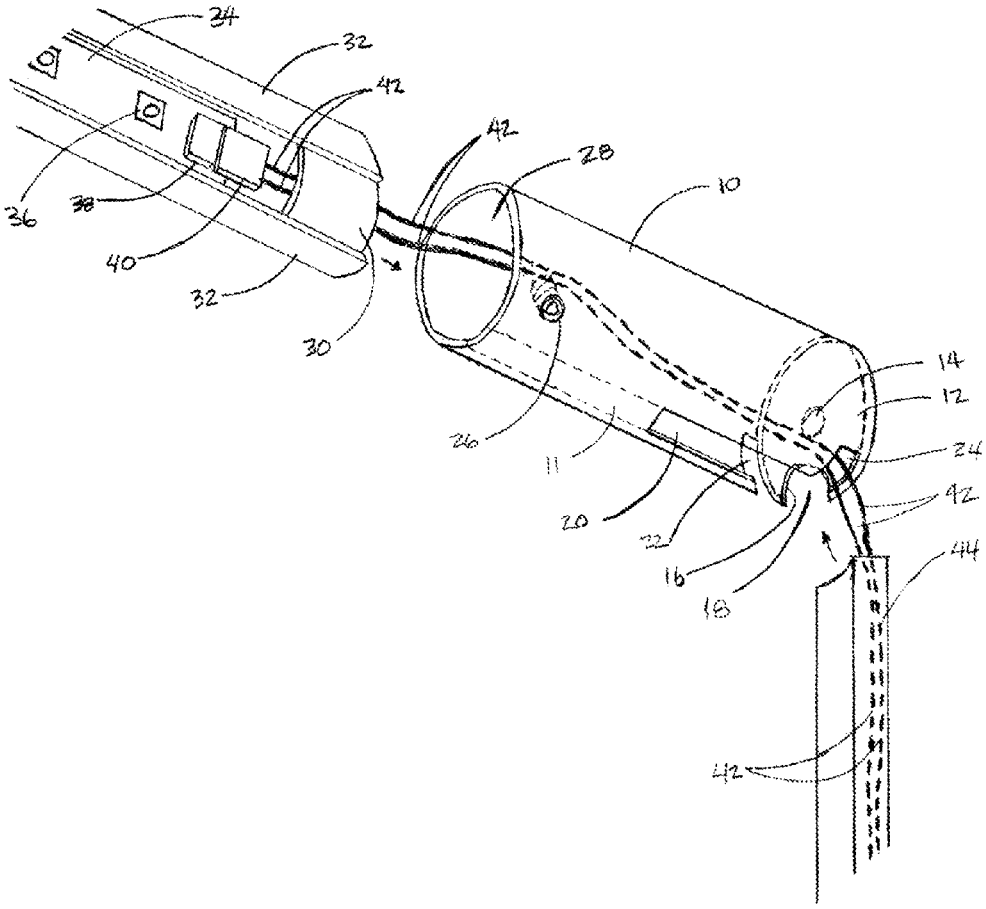
FIG. 1 is a perspective, break-away drawing of the side mount bracket looking up from the inside center of a display case. The four components broken apart here are the light tube assembly with LED circuit board, side mount bracket, wire harness down rod and wire harness with connector.

Detailed Description—FIGS. 1, 2, 3A to 3F and 4—First Embodiment One embodiment of the bracket and light tube system is FIG. 1 (exploded, perspective view) showing the light tube 32 with the locking collar 30 as it fits partially into the bracket 10 to allow the set screw 26 to press firmly against the locking collar that holds the light tube permanently in position. The locking collar also allows for the wire harness 42 to move freely under it without being inadvertently pinched while locked in position. The space under the locking collar and the adjacent space between the end of the light tube and the bracket base 12 additionally provides room to place excess wire that does not retract into the side of the case or in the down rod.

Figure 2:
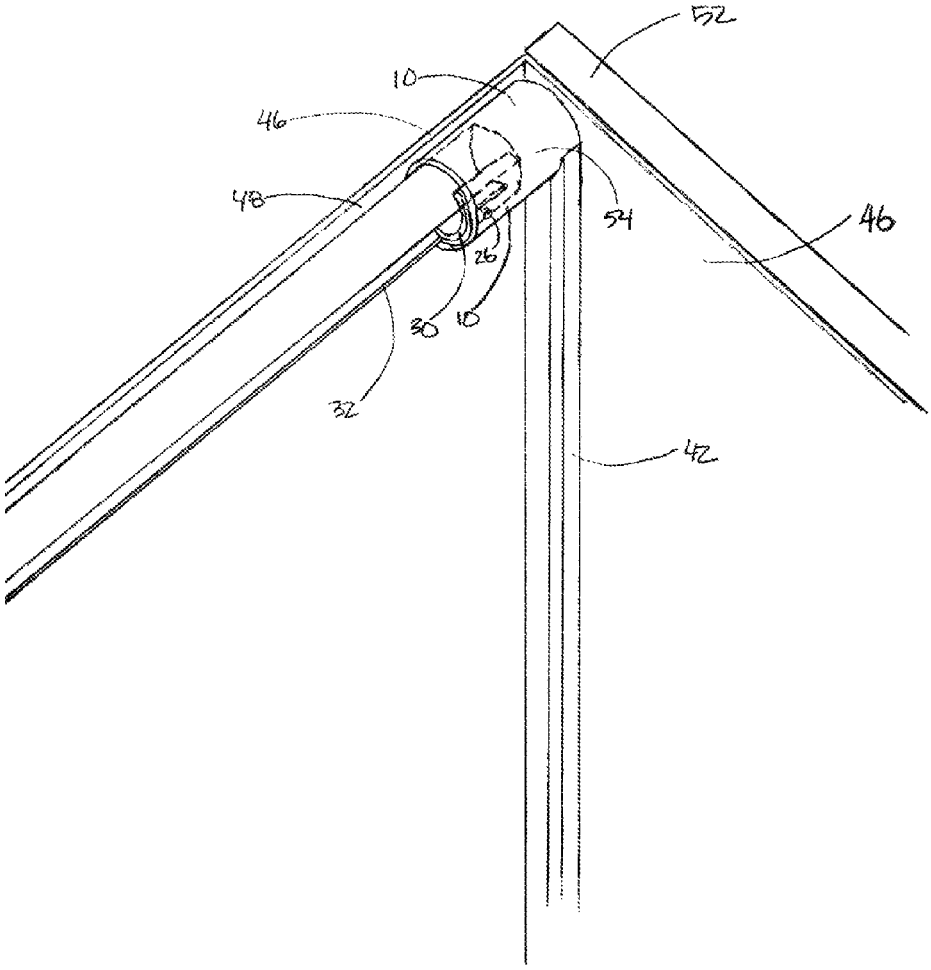
FIG. 2 is a perspective drawing looking down at the installed light tube through the display case top glass.
Figure 3A:
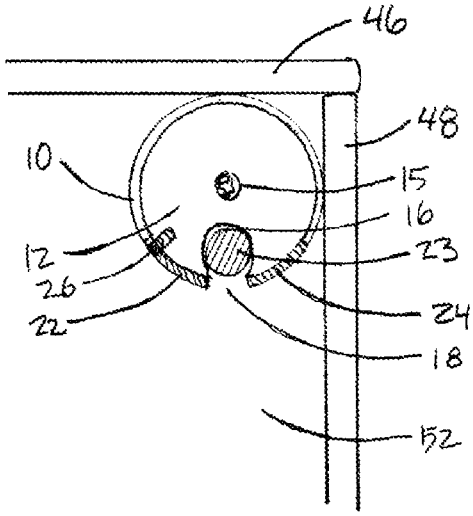
FIGS. 3A to 3D are side views of the installed bracket without the light tube installed, showing the through-hole position of the bracket and the various types of down rod positioning in the event that through-hole feeding of the wire is not possible.
Figure 3B:
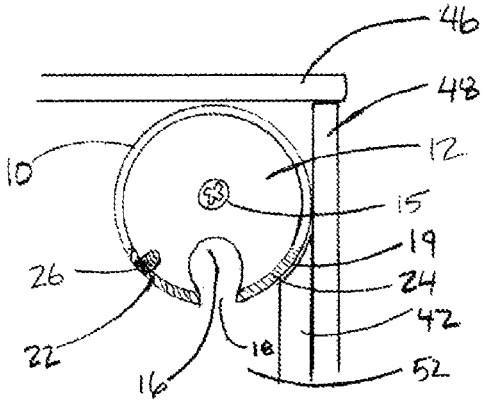
Figure 3C:
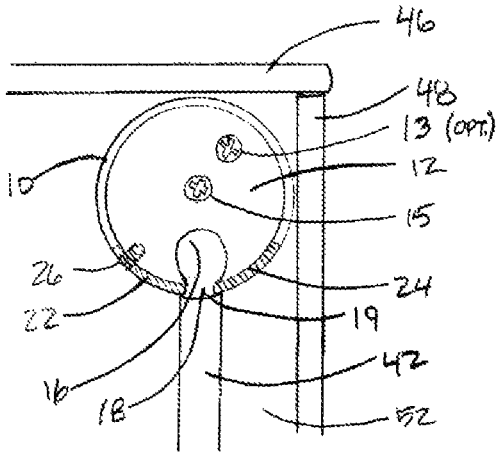
Figure 3D:
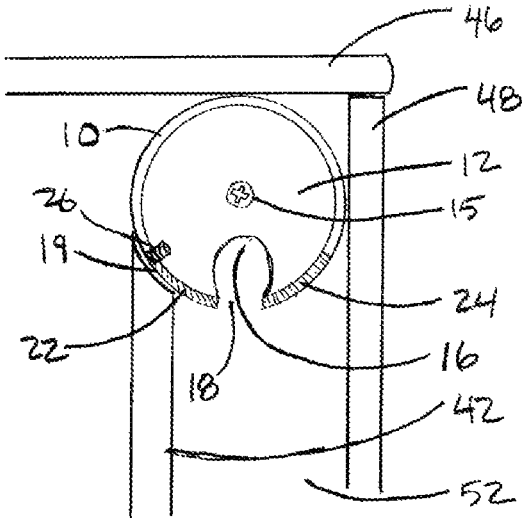
Figure 3E:
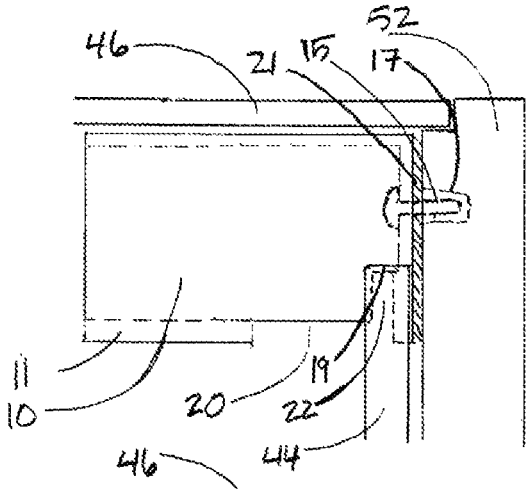
FIGS. 3E and 3F are front views of the side of the bracket showing the visible cut-outs or pass-throughs to feed the wire harness.
Figure 3F:
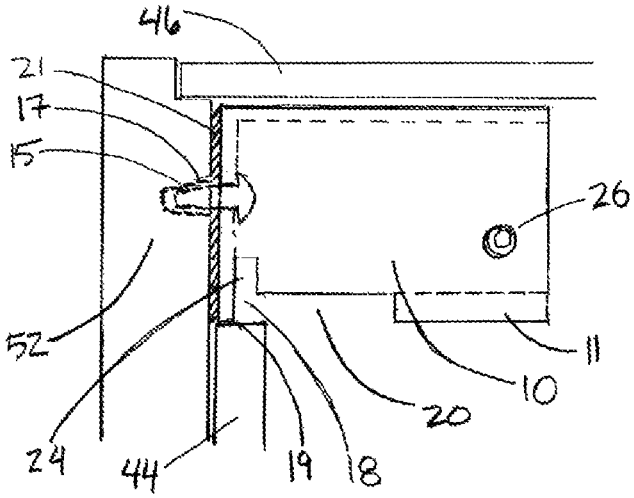

FIG. 2 (perspective view) illustrates the assembled positions of the light tube and locking collar with respect to the bracket and down rod 44. The wire harness pass-throughs 20, 22, 24 and 11 are positioned on the bottom area of the bracket to be hidden from the perspective of a person standing at the display case. At least one pass-through (in this instance 24) will be completely hidden from view by the down rod on the forward side of the bracket. FIGS. 3B, 3C and 3D show some typical examples of the positions of the down rods with respect to the bracket, wire harness pass-throughs and the case glass. In some applications, the wire harness will be routed through a small hole (FIG. 3A) 23 in the side of the case 52 and will not necessitate the use of the down rod.

Figure 4A:
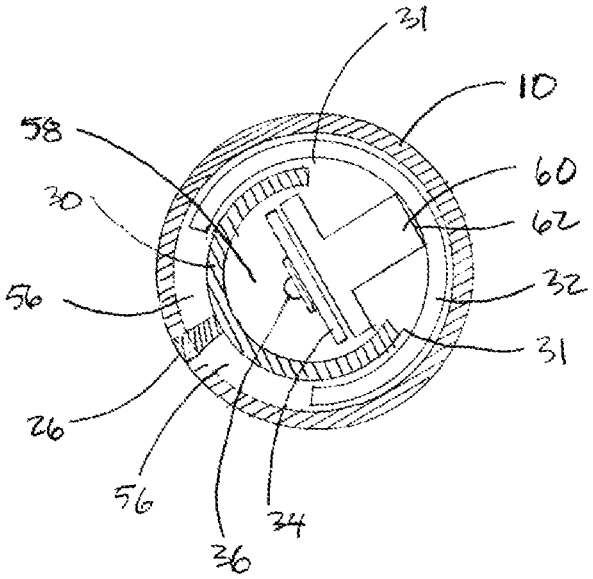
FIGS. 4A and 4B are cut-away drawings of the edge of the assembled bracket and LED light tube showing their relation to the locking collar and set screw.
Figure 4B:
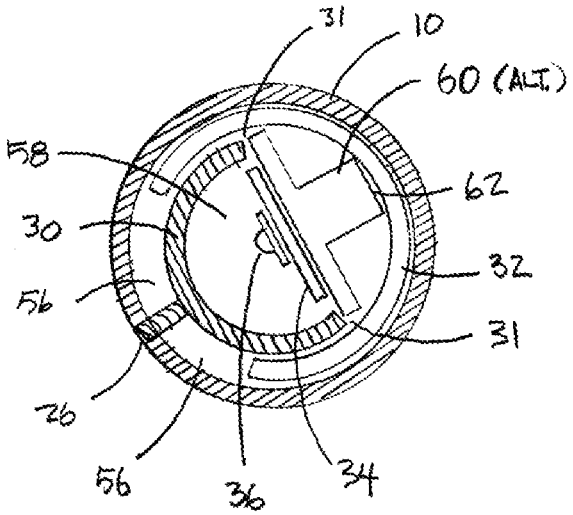

FIG. 4 (cross-section) illustrates the relation of all the components which fit into the bracket 10 when installed. The locking collars 30 are first installed tightly into each end of the light tube before it is placed into each of the installed brackets at the left and right sides of the display case. Once in place, the light tube is tightened into position using the set screw 26. There is ample space 56 to adjust the up and down position of the light as desired before tightening. As the set screw is tightened, the leading ends 31 of the locking collar will expand and grip to the inside edge of the light tube 31 making a secure connection to hold the light tube in place. The LED circuit board mounting pedestal 60 is situated so as not to obstruct with the action of the locking collar.

Operation—FIGS. 1, 2, 3A to 3F and 4

In this first embodiment the brackets 10 are first mounted to each of the two sides of the display case 52 in the upper-most corners of the case FIG. 2 (top perspective view) by first drilling a pilot hole 17 for the mounting screw 15 on both sides of the case where the brackets are to be mounted. (The bracket is a cylinder shape with a bottom 12 and no top, the bottom being the part that the mounting screw will go through to hold the bracket to the side of the display case. The inside diameter of the bracket is slightly larger than the outside diameter of the light tube). The adhesive tape 21 is then applied to hold the bracket in position, and the mounting screw is installed to fasten the bracket to the side of the case. The adhesive tape serves two functions; to hold the bracket in place while the mounting screw is installed, and to restrict the bracket from twisting in position. In extreme cases and where possible, a second mounting screw 13 can be installed to further resist twisting of the bracket from the side wall of the case. In special instances, the bracket may also be installed without the mounting screw and can be held in place with only the adhesive.

For installations using the down rod 44 for the wire harness 42, the down rod is then cut to fit to the case at time of installation. The bottom of the down rod is to extend to the bottom of the inside of the display case and to the top to fit the contour of the round bracket 19 so as to hide completely the wire harness when installed. The down rod is made of thin gauge aluminum or plastic making it easy to field cut each down rod at time of installation. Each case will need a custom-fit down rod to properly hide the wire harness from view. Before installation of the down rod, the wire harness is fed into the down rod, through the bottom of the case and then installed in position against the case side while at the same time feeding the wire connector 40 and harness through the connector pass-through 20 (and 11) and into pass-through 22 or 24. For installations where the wire harness is to be fed through a hole 23 drilled in the side of the case, the wire harness is first fed into the pass-through hole 16 and 18 at the bracket. The connector and the wire harness are then fed into pass-through 20 (and 11) to later be connected to the LED circuit board 34 when the light tube is installed. Once both sides are installed, the light tube can be slid into both left and right side brackets while the connector is fed under the locking collar 30 and attached to the circuit board connector 38. The light is then powered on and positioned for optimum or desired beam angle to properly light the case and then locked into position by adequately tightening the set screw 26. Only one set screw on either the left or right bracket should be tightened to allow the light tube to freely move left and right as the light tube expands and contracts with temperature changes when initially turned off and on.

Figure 5A:
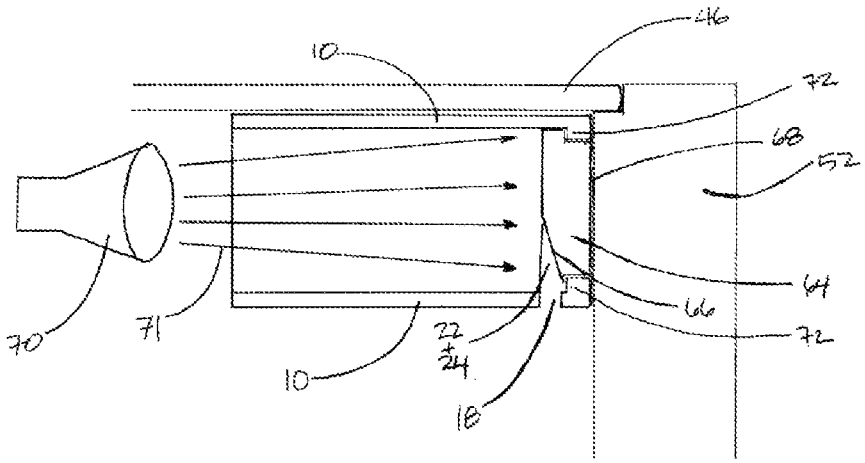
FIG. 5A is the front view of the side mount glue-on bracket using the polycarbonate flange base for installation to an opaque side surface using UV-cure adhesive. Polycarbonate is used to allow the UV light rays to penetrate the bracket base and cure the adhesive for quick installation.
Figure 5B:
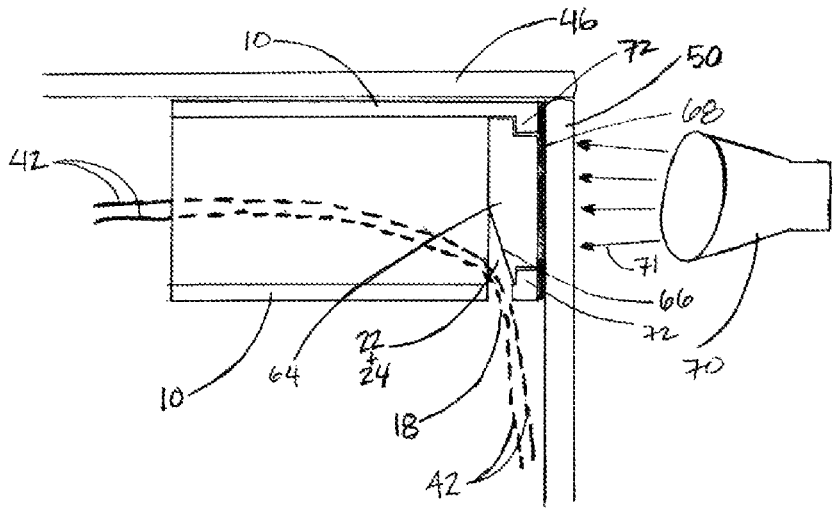
FIG. 5B is the front view of the side mounted glue-on bracket using the polycarbonate bracket base for installation to a transparent or glass surface using UV-cure adhesive.
Figure 5C:
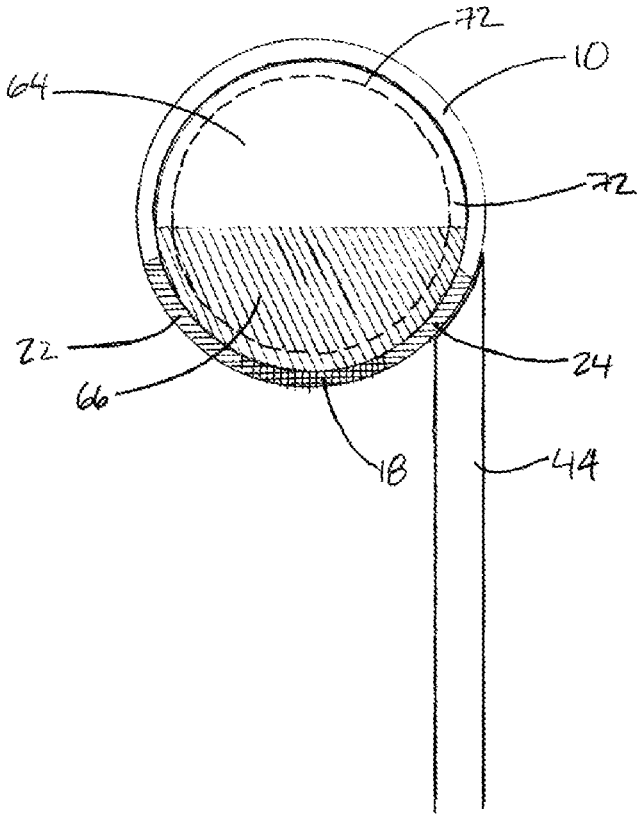
FIG. 5C is the side view of the side mounted glue-on bracket showing the detail of the bevel to allow routing of the wiring harness through the cut-outs or pass-throughs to the down rod.

FIGS. 5A to 5C—Alternative Embodiment

Alternative embodiment is shown in FIGS. 5A, 5B and 5C where a modified version of the bracket base 64 is used to install the side-mounted bracket more permanently to the side of the display case 48 and 52 where a mounting screw is not practical or desired. In this instance, the bracket base 12 is partially cut out from the previously described bracket 10 to provide an opening and retaining lip 72 to place and permanently affix the transparent plastic bracket base piece. The bracket base is further beveled 66 on the lower half of the base piece to allow space for routing the wire harness 42 through the pass-through 22 or 24 and 18. Installation of the bracket requires applying the UV-cure adhesive 68 to the base of the bracket and affixing it to the case side. The bond of the uncured adhesive is sufficiently strong enough to hold the light weight bracket in place while a UV lamp 70 is used to permanently cure the adhesive within approximately five minutes of exposure time. FIG. 5A illustrates UV light exposure 71 of the adhesive from the inside of the bracket when installing on to opaque surfaces 52 such as wood, metal or opaque plastics. FIG. 5B illustrates UV exposure of the adhesive from the outside of the case through a transparent case side 48 such as glass or transparent plastic. Once cured the LED light tube is installed as previously described, routing the wire harness through the down rod, through the installed bracket and to the light tube. The light tube is then installed and locked in to position with the set screw.

Figure 6A:
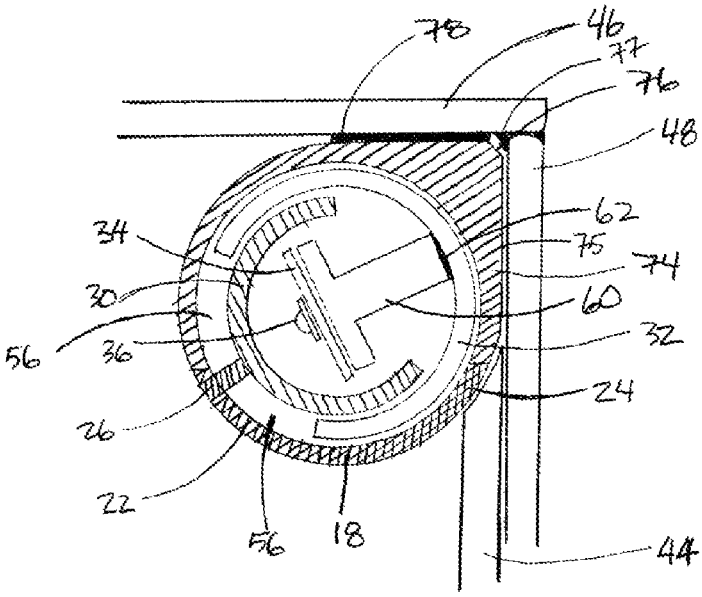
FIG. 6A is the side view of the top-mount-to-underside-of-glass bracket with the light tube and locking collar installed with the typical location of the down rod for the routing of the wire harness.
Figure 6B:
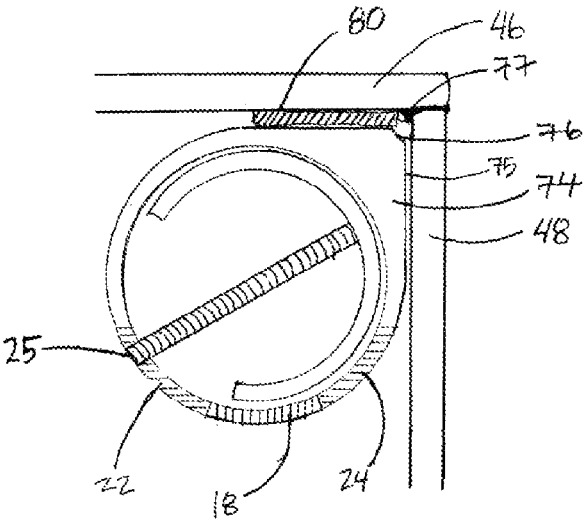
FIG. 6B is the side view of the top-mount-to-underside-of-glass bracket without the light tube installed showing detail of the wire routing cut-out, adhesive strip and the related clearance bevel.
Figure 6C:
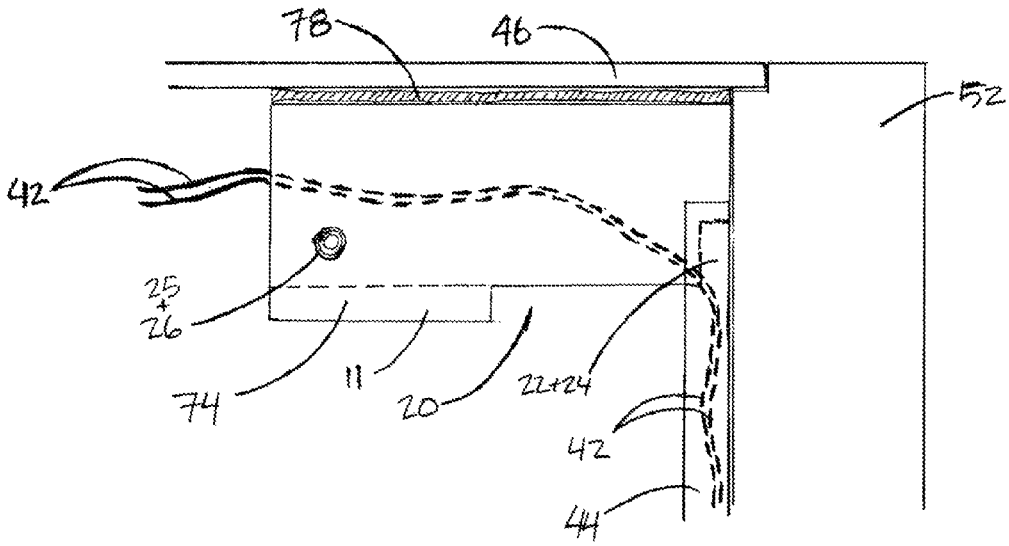
FIG. 6C is the front view of the top-mount-to-underside-of-glass bracket showing the adhesive strip, wire harness routing and typical position of the down rod.

FIGS. 6A, 6B and 6C—Alternative Embodiment

In instances where side mounting of the brackets and light tube is not desired or practical, top mounting of the bracket 74 to the underside of the top display case glass 74 can be alternatively used to provide a secure and aesthetically pleasing method of installation of the light tube 32. Orienting the cut out pass-throughs 18, 22, 24 and 11 against the side wall of the case as performed with the side mount brackets, the top-mount bracket is installed using double-sided adhesive tape 80 or liquid adhesive 78 and pressed firmly to the underside of the top glass. The adjacent and perpendicular flat edge of the bracket 75 is used to guide the bracket squarely along the inside of the front glass 48 to ensure a parallel and square bond of the bracket to the top glass. Bevel 76 provides two important functions; to allow the bracket to fit tightly to the corner of the case glass and clear any previous adhesive remnants 77 that may exist from the installation of the case glass and to keep the new bonding adhesive clear of the inside of the front glass when sliding the bracket up in to place against the top glass. The bevel will further allow for expansion of the adhesive when pressed in to place, thereby insuring an even, complete bond of the adhesive surface to the top glass. In instances where a locking collar is not desired or practical, a single, long set screw 25 can be placed to affix the bracket to the LED light tube. FIG. 6C is a front view of the top-mount bracket showing the wire harness being threaded through the bracket and in to the down rod as previously described for the side-mount bracket.

Figure 7A:
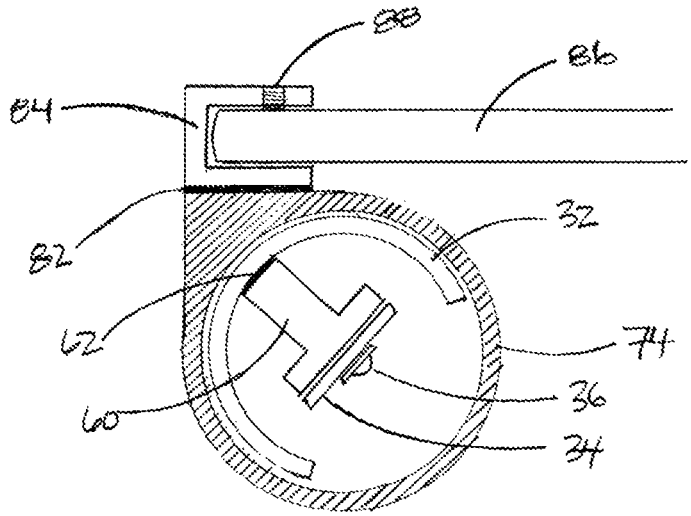
FIG. 7A is the side view of the top mount bracket with the light tube and locking collar installed adapted with a u-channel to fit the bracket to the front edge of a glass or thin-material shelf.
Figure 7B:
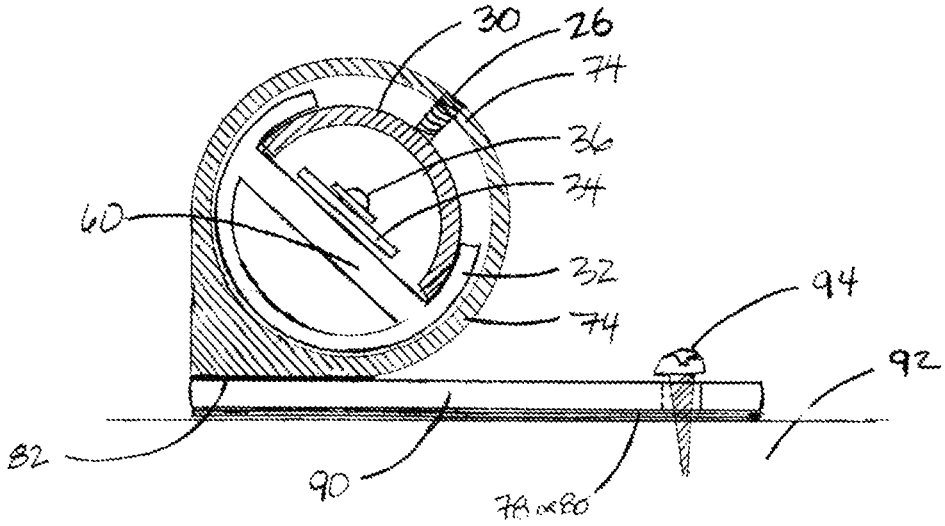
FIG. 7B is the same top mount bracket adapted to fit onto a ledge for installation or placement on a wall, soffit, under cabinet or any desired flat surface. This figure illustrates use of the same locking collar in conjunction with an alternate design of light tube extrusion.

FIGS. 7A and 7B—Alternative Embodiment

There exists various alternative adaptations of the top mount bracket for use with other applications and uses of linear LED light tubes. FIG. 7A shows the top-mount bracket 74 to be permanently affixed to a u-channel 84 for adapting the bracket and light tube to fit on the edge of glass or thin material shelves or ledges 86. The u-channel is affixed to the bracket using a permanent adhesive such as epoxy 82 which creates a strong and clean bond. The u-channel and bracket piece is then positioned and affixed to the glass shelf with one or more set screws 88 which binds the bracket to the glass. The set screw is firmly tightened to the glass shelf so as to hold the bracket in place, but not so tight as to chip, crack or break the shelf. This allows the entire light tube assembly to be removed or repositioned without any damage to the shelf.

The additional alternative embodiment as shown in FIG. 7B is to permanently mount the top-mount bracket to a flat base plate 90, which in turn, allows the bracket to be affixed to any flat surface. Attachment to the flat surface may be achieved by the use of an adhesive 78 or adhesive tape 80 or by installing one or more mounting screws 94 as shown, or by a combination of the two. FIG. 7A is shown without the locking collar and set screw to simplify the illustration. However, it is designed to use these components to complete the assembly and installation of the light tube and bracket assembly. FIG. 7B shows an optional light tube design using the same locking collar. The use of a long set screw may also be employed as needed as illustrated in FIG. 6B. The wire harness pass-throughs 20, 22, 24 and 18 may or may not be used with this alternatively adapted top-mount bracket. Consequently, this embodiment may not use the down rod which is desirable for other iterations of this bracket design. This alternative adaption of the bracket will usually not have a bracket base 12 or mounting hole 14 and the related wire cut-out 16 or wire space 18.

Advantages

As illustrated in the above descriptions, there are numerous advantages to the embodiments of the LED light tube assembly.

(a) The mounting brackets can be installed in the display cases or other intended surfaces independent of the light tube, thus allowing exact and correct placement of the brackets without interference from the light tube and wiring harness when installing the light.

(b) The side mount brackets may be securely fastened to the side wall of the case with a mounting screw where practical or optionally mounted using clear adhesive. The later method can allow removal of the bracket without damage to the case wall. This is especially important when mounting to glass side walls of display cases.

(c) The pass-throughs in the bracket allow for the wire harness to be hidden from view using either the down rod or feeding the wire in to the side wall of the case.

(d) The pass-throughs in the bracket allow the wire harness to be removed and replaced once the bracket has been semi-permanently affixed to the case. This facilitates removal and replacement of the light tube for service or inspection as well as removal and replacement of the wire harness without removing the brackets.

(e) The design of the bracket allows room to adjust the lateral position of the light tube within the two side brackets to accommodate for slight differences in equal but slightly different cases.

(f) The additional room for side-to-side movement of the light tube also provides flexibility to cut the light tube to fit the brackets in the event the tube is manufactured too long.

(g) The additional room allows an area to gather extra wire which does not retract into the down rod or side wall of the case. This keeps the wire harness and connector from tethering too tightly from the circuit board once installed.

(h) This design is universal in that it allows the wire harness to enter from either side of the case without removing or switching the brackets.

(i) This design allows the down rod to be independently installed to the case side after the light tube is properly connected to the wire harness and is aligned and secured with the set screw.

(j) The design allows for the light tube to expand and contract with changing temperatures through the day so as not to put undesirable forces on the brackets to break free from their attachment to the case.

(k) The design minimizes the number of components necessary to properly and efficiently install the LED light tube thereby reducing the cost of manufacture and subsequent cost to the customer.

(l) The design allows the bracket and light tube to be installed into the uppermost corner of the display case thereby blending with the edge of the display glass top and creating a more aesthetic appearance.

(m) The design embodiment as shown in FIGS. 6A and 6B allows for a simple, quick and precise installation of the top-mount bracket to the underside of the top glass of a display case. This design utilizes the same design elements as the side-mount bracket using the pass-throughs and locking collar which simplifies the installation of the light tubes in locations using a combination of both side and top mount brackets.

(n) The top-mount bracket design is universal to allow it to be adapted to fit other applications such as attachment to glass shelves and to any flat surface such as walls, soffits and ledges and under cabinets.

Conclusion, Ramifications and Scope

The reader will clearly see that the light tube mounting system and its alternative embodiments permits a simple, quick and secure method of installing LED linear lighting while maintaining aesthetic appearance and reduced cost. The light tube system additionally permits the ease of repair, adjustment of the light beam angle and minimizes any damaged caused to the case when the light system is removed. The systems for side and top mounting allow for a universal use of the design for a variety of linear LED lighting applications.

Although the light system is designed to be a small as possible to fit the LED light components, it may be applied to other applications that require the light tubes to be significantly larger than conveyed here. The design may be scaled up or down proportionally to utilize this design for applications of different sizes and scale. Additionally, the components of the design are intended to be constructed of extruded or milled aluminum for the purpose of durability, rigidity, appearance and thermal capacity. Alternatively, the design may use other materials such as different forms of plastic or metals that function equally well with the intended purpose, use and application of the design.

What is claimed is:

1. An assembly for mounting a cylindrically-shaped light tube to the inside wall of display cases, which light tube consists of LED light components mounted on circuit boards, which are internally mounted on to a pedestal strip, which is internally mounted to the inside plane of said light tube, which is then mounted to a cylindrical mounting bracket comprising:

a cylindrical tube whose inside diameter is slightly larger than the outside diameter of said light tube; and a base at one end of said mounting bracket that is to fit flush against said wall of said display case; and a mounting hole in the center of said base to place a mounting screw to attach said mounting bracket to a side of said display case with the option of placing a second mounting screw for a more secure attachment; and the placement of an adhesive on the underside of said base to hold said mounting bracket in place during installation of said mounting screw(s) which also serves to resist twisting of said mounting bracket away from its position on the surface of said wall of said display case; and a lateral cut adjacent and parallel to the base of said cylindrical mounting bracket large enough to permit the placement of a wire harness through the lower half of the mounting bracket and into a wire harness down rod; and a horizontal cut extending at least one-third the length of said cylindrical mounting bracket large enough to fit a connector and said wire harness leading to said circuit board(s); and a ¾ circle notched out of the base of said mounting bracket to accommodate said wire harness for through-the-case wiring; and a threaded hole near the open end opposite of said base of said mounting bracket for placement of a set screw to firmly affix said light tube to said mounting bracket.

2. The assembly of claim 1 whereas said light tube is modified with a locking collar resembling the shape of a semi-cylinder whose outside diameter is slightly smaller than the inside diameter of said light tube, whose length is no less than ⅛th inch and typically no more than three inches, and is placed firmly at the ends of said light tube so as to provide an area of attachment for said set screw whereas;

said collar is removable and whose position is adjustable at time of installation;

said collar when tightened against by said set screw binds to the inside walls of said light tube firmly holding said light tube in position;

said collar provides a clear path to guide said connector and said wire harness to a circuit board connection;

said collar will be tightened against by said set screw usually on one side of said light tube to allow for material expansion and contraction;

the exposed face of said collar, once installed, provides for adjustment of said light tube's light beam angle within said display case.

3. An assembly of claim 2 whereas said locking collar may be removed in certain circumstances and a long set screw running the inside width of said mounting bracket and said light tube is used in place of said collar to firmly hold said light tube in place.

4. The assembly of claim 1 whereas said horizontal cut may be extended from one-third the length of said cylindrical mounting bracket to the entire length of the cylindrical mounting bracket to allow the placement of said wire harness at any point along said cylindrical mounting bracket.

5. The method of assembly of claim 1 whereas said wire harness is fed through said lateral cut and further to a down rod to conceal said wire harness within said display case:

whereas said wire harness can be installed or removed without removing said installed mounting bracket;

whereas said wire harness and said down rod can be placed in multiple locations around said mounting bracket as desired;

whereas said down rod can be cut at time of installation for an exact fit within said display case.

6. The assembly of claim 1 in an alternative embodiment that provides for an alternative side-mounted bracket that may be applied to a side of said display case wall without the use of said mounting screws and is manufactured and installed alternatively:

by removing the center portion of said base of said mounting bracket while retaining a small retaining lip around the inside surface of said mounting bracket and base;

by permanently affixing with adhesive a clear plastic or polycarbonate circular mating base piece which is alternately milled to fit said small, inside retaining lip and open space;

by providing a bevel along the bottom half of said circular base piece to allow for said wire harness to pass through to said lateral cut to feed in to said down rod;

by applying an ultra-violet light cure adhesive to said bottom of said base piece and affixing said mounting bracket to said wall of said display case;

by use of non-opaque plastic that forms said base piece allows for said adhesive to be cured from either the front or rear side of said base piece.

7. An assembly for mounting a cylindrically-shaped light tube to the underside of the top glass of display cases, which light tube consists of LED light components mounted on circuit boards, which are internally mounted on to a pedestal strip, which is internally mounted to the inside plane of said light tube, which is then mounted to a cylindrical mounting bracket comprising:

a cylindrical tube whose inside diameter is slightly larger than the outside diameter of said light tube; and a lateral cut at the base of said cylindrical mounting bracket large enough to permit the placement of a wire harness through the lower half of the mounting bracket adjacent to the wall of said display case and into a wire harness down rod; and a horizontal cut extending at least one-third the length of said cylindrical mounting bracket large enough to fit a connector and said wire harness leading to said circuit board(s); and a threaded hole near the open end of said mounting bracket, which end is opposite to the base of said mounting bracket, for placement of a set screw to firmly affix said light tube to said mounting bracket;

whereby only one side of said light tube will normally be fastened with said set screw to allow said light tube assembly to expand and contract with changes in temperature throughout the LED light operating hours;

two flat edges adjacent and perpendicular to each other and positioned along horizontal and vertical planes that are tangential to two apexes 90 degrees apart along the radius of the length of said cylindrical mounting bracket;

whereby said flat edges are utilized to fit said mounting bracket into the uppermost corner of said display case top glass and side glass;

whereby said vertical flat edge of said mounting bracket is utilized as a guide to move said mounting bracket squarely into position and parallel along said side glass up to the underside of said top glass, as well as stabilize said mounting bracket against the glass surface once in place;

whereby said horizontal edge of said mounting bracket is utilized as a surface to apply an adhesive to make a bond to said underside of said top glass;

whereby a bevel of variable size at the apex of said two flat edges is provided as clearance for any existing adhesive residue or obstruction at the corner of said top and side glass, and to restrict application adhesive on said horizontal edge from touching the surface of said front glass while it is slid into position up to said top glass;

whereby said adhesive may be liquid adhesive or double-sided adhesive tape.

8. The assembly of claim 7 utilizing said mounting bracket to install on thin or glass shelves:

whereby a u-channel is permanently affixed laterally along the length of one of the said flat edges of said mounting bracket;

whereby said u-channel is permanently affixed to said mounting bracket with epoxy or other high-bond adhesive;

whereby the mounting bracket and u-channel assembly is affixed to a glass shelf with one or more set screws that, when tightened, sufficiently pinch said glass shelf holding said mounting bracket assembly to said glass shelf.

9. The assembly of claim 7 to affix the mounting bracket to a flat base plate for mounting to a plurality of flat surfaces such as soffits, walls, under cabinets and ledges;

whereby said mounting bracket is affixed to said flat base plate with epoxy or other high-bond adhesive;

whereby the mounting bracket assembly is affixed to said flat surfaces using said adhesives or an attachment screw or a combination of both;

whereby said mounting bracket assembly may be installed vertically or horizontally or at any angle as desired.

10. The assembly of claim 7 whereby said light tube is modified with a locking collar resembling the shape of a semi-cylinder whose outside diameter is slightly smaller than the inside diameter of said light tube, whose length is no less than ⅛th inch and typically no more than three inches, and is placed firmly at the ends of said light tube so as to provide an area of attachment for said set screw whereby;

said collar is removable and whose position is adjustable at time of installation;

said collar when tightened against by said set screw binds to the inside walls of said light tube firmly holding said light tube in position;

said collar provides a clear path to guide said connector and said wire harness to a circuit board connection;

said collar will be tightened against by said set screw usually on one side of said light tube to allow for material expansion and contraction;

the exposed face of said collar, once installed, provides for adjustment of said light tube's light beam angle within said display case.

11. The assembly of claim 7 whereas said locking collar may be removed in certain circumstances and a long set screw running the width of said mounting bracket and said light tube is used in place of said collar to firmly hold said light tube in place.

12. The assembly of claim 7 whereas said horizontal cut may be extended from one-third the length of said cylindrical mounting bracket to the entire length of said cylindrical mounting bracket to allow for the placement of said wire harness at any point along said cylindrical mounting bracket.

13. The method of assembly of claim 7 whereas said wire harness is fed through said lateral cut and further to said wire harness down rod to conceal said wire harness within said display case:

whereas said wire harness can be installed or removed without removing said installed mounting bracket;

whereas said wire harness and said down rod can be placed in multiple locations around said mounting bracket as desired;

whereas said wire harness down rod can be cut at time of installation for an exact fit within said display case.

* * * * *